US008760073B2

(12) United States Patent
Ko

(10) Patent No.: US 8,760,073 B2
(45) Date of Patent: Jun. 24, 2014

(54) HIGH-EFFICIENCY AC-DRIVEN LED MODULE

(75) Inventor: Gowan Soo Ko, Suwon-si (KR)

(73) Assignees: S&J Co., Ltd., Yongin-Si (KR); Gowan Soo Ko, Suwon-Si (KR)

( * ) Notice: Subject to any disclaimer, the term of this patent is extended or adjusted under 35 U.S.C. 154(b) by 448 days.

(21) Appl. No.: 13/222,220

(22) Filed: Aug. 31, 2011

(65) Prior Publication Data

US 2013/0026930 A1 Jan. 31, 2013

(30) Foreign Application Priority Data

Jul. 26, 2011 (KR) ..... 10-2011-0073851

(51) Int. Cl.
*H05B 37/02* (2006.01)

(52) U.S. Cl.
USPC ..... 315/247; 315/185 R; 315/308

(58) Field of Classification Search
CPC ..... H05B 37/00; H05B 37/02; H05B 33/00; H05B 33/08; H05B 33/0803; H05B 33/0806; H05B 33/0896; H05B 33/0821; H05B 33/0824; H05B 33/083; H05B 33/0815; Y02B 20/345; Y02B 20/347
USPC ..... 315/185 R, 193, 186, 247, 246, 291, 315/307, 308
See application file for complete search history.

(56) References Cited

U.S. PATENT DOCUMENTS

2011/0084619 A1* 4/2011 Gray et al. ..... 315/185 R
2012/0229046 A1* 9/2012 Melanson ..... 315/247

* cited by examiner

*Primary Examiner* — David H Vu
(74) *Attorney, Agent, or Firm* — Lexyoume IP Meister, PLLC

(57) ABSTRACT

A high-efficiency Alternating Current (AC)-driven Light-Emitting Diode (LED) module includes a full-wave rectification unit, an LED unit, at least one instantaneous current control unit, and at least one input power compensation unit. The full-wave rectification unit rectifies commercial supply voltage. The LED unit is configured such that LEDS connected in series are arranged separately or in groups. The instantaneous current control unit sequentially controls the sections of the LEDs connected in series. The input power compensation unit actively controls variations in input current and power attributable to variations in input voltage. The full-wave rectification unit, the LED unit, the instantaneous current control unit, and the input power compensation unit are formed of a one-board module (ASIC) or an Integrated Circuit (IC).

4 Claims, 8 Drawing Sheets

FIG. 9
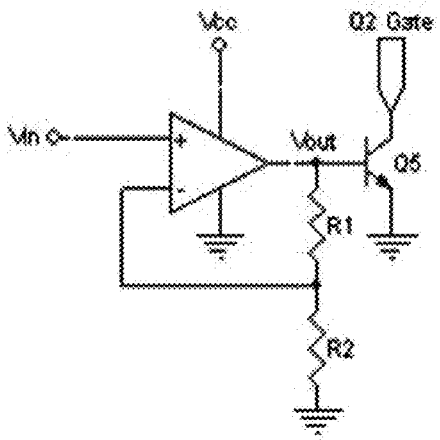
FIGS. 10a-10c
(a)
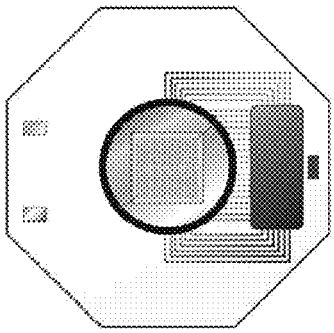
(b)
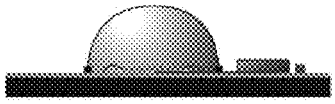
(c)
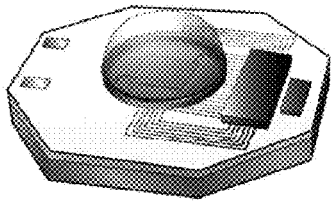

HIGH-EFFICIENCY AC-DRIVEN LED MODULE

CROSS REFERENCES

Applicant claims foreign priority under Paris Convention and 35 U.S.C. §119 to Korean Patent Application No. 10-2011-0073851, filed Jul. 26, 2011, with the Korean Intellectual Property Office, where the entire contents are incorporated herein by reference.

BACKGROUND OF THE INVENTION

1. Field of the Invention

The present invention relates generally to a high-efficiency Alternating Current (AC)-driven Light-Emitting Diode (LED) module and, more particularly, to a high-efficiency AC-driven LED module that improves power and current differences attributable to variations in input voltage and an undesirable power factor, that is, the most important problems of conventional AC LEDs, using a method of rectifying commercial voltage using a bridge diode, sequentially controlling the sections of an appropriate (maximum commercial voltage*√2/Diode $V_F$) number of LED chips connected in series, and driving them while increasing current, so that regulations (equal to or higher than PF 0.9) in respective countries can be met and also the power efficiency of an LED lamp (to a value equal to or higher than about 95%) can be maximized by minimizing control loss.

2. Description of the Related Art

Light-Emitting Diodes (LEDs) are current-driven devices, and can operate only when constant current is stably supplied thereto.

Of these LEDs, small-sized LEDs may be controlled using the method shown in FIG. 1.

For example, FIG. 1 illustrates one method for controlling LED lamps. This method has the disadvantage of the manufacturing cost of a related system being expensive because LEDs are lit using a Switched-Mode Power Supply (SMPS), that is, a conventional DC voltage conversion device, and a constant current driver.

In particular, it is necessary to solve various problems with the control method, that is, the problem of the short life span of LEDs attributable to the short life span (MTBF: about 10,000 HR-20,000 HR) of electrolytic capacitors C1, C3, C4 and C5, the problem of electromagnetic interference attributable to the SMPS switching method, the problem of heat dissipation attributable to the assembly structure, and a low energy conversion efficiency of about 80%.

In order to mitigate the above problems, some LED manufacturers developed the AC LEDs shown in FIG. 2. Because of the fundamental characteristic of LEDs that they are sensitive to excessive voltage (excessive current), such AC LEDs are being sold and manufactured at working voltages at regular intervals of 10 V.

Furthermore, this issue is related to the most important problem. Although AC LEDs themselves can comply with the power factor regulations (being equal to or higher than 0.85 in the case of LEDs equal to or lower than 5 W), the LED lamps (bulbs, down-lights, tubes, or flat or street lights) using such AC LEDs cannot comply with the power factor regulations (being equal to or higher than 0.9) in terms of the input power of a lamp, as shown in FIG. 3, and therefore it is difficult to obtain lamp standard certifications in respective countries.

Furthermore, the efficiency thereof is poor because the AC LEDs are composed only of passive elements, such as bridge diodes and resistors, and the brightness of an LED lamp is not constant but abruptly changes because the current is not actively controlled in connection with variations in input voltage and therefore input power and current abruptly decrease or increase in the range of variations in voltage.

The AC LEDs are problematic in that it is difficult to satisfy the respective standards of countries, the life span and optical flux of the AC LEDs may be degraded by heat, and the reliability of the AC LEDs may be considerably decreased.

Although recently an AC-driven LED driver capable of mitigating the power factor problem of AC LEDs has been developed, a high loss occurs in active elements in the higher interval of a rated voltage range due to a relative decrease in efficiency in a constant current controller in terms of the VF characteristics of the LEDs, thereby degrading the efficiency of the LEDs.

SUMMARY OF THE INVENTION

Accordingly, the present invention has been made keeping in mind the above problems occurring in the prior art, and the present invention has the following objects.

A first object of the present invention is to overcome the problem of low efficiency attributable to the conventional SMPS constant-current method (the efficiency problem attributable to energy conversion), the AC LED (the efficiency problem attributable to the use of passive elements), and the AC-driven LED driver (the efficiency problem attributable to loss in active elements in the higher interval of a rated voltage range), thereby increasing the efficiency to a level equal to or higher than about 95%.

A second object of the present invention is to mitigate the problem of a short life span (MTBF: about 10,000 HR-20,000 HR) that is caused by an electrolytic capacitor frequently used in an SMPS constant-current control method, thereby increasing the life span of an LED lamp (to a level similar to that of the LEDs themselves).

A third object of the present invention is to increase the power factor of an LED lamp to a value equal to or higher than 0.95 by improving the low power factor (about 0.85) of AC LEDs based on LED characteristics.

A fourth object of the present invention is to overcome the problems of the size and cost of an EMI filter inserted to deal with EMI which occurs in SMPS high frequency switching and the problem of EMI countermeasures.

A fifth object of the present invention is to make the irregular brightness of an LED lamp attributable to variations in the input voltage of an AC LED or abrupt variations in input power and current as constant as is possible.

A sixth object of the present invention is to enable dimming to be stably controlled over a wide range and allow a dimming start point to be controlled, since a triac-dimming control range is narrow due to the characteristics of AC LEDs.

A seventh object of the present invention is to solve the problem that it is difficult to achieve a small size, integration and automated manufacturing due to a complicated circuit and passive parts, such as an inductor, thereby degrading manufacturing efficiency.

An eighth object of the present invention is to overcome the problem of designing an LED driver in conformity with the type of LED lamp by standardization.

A ninth object of the present invention is to overcome the problem that heat dissipation design is difficult because a complicated structure is required by an internal LED driver.

In order to accomplish the above objects, the present invention provides a high-efficiency AC-driven LED module, including a full-wave rectification unit configured to rectify commercial supply voltage; an LED unit configured such that LEDS connected in series are arranged separately or in groups; at least one instantaneous current control unit configured to sequentially control sections of the LEDs connected in series; and at least one input power compensation unit configured to actively control variations in input current and power attributable to variations in input voltage; wherein the full-wave rectification unit, the LED unit, the instantaneous current control unit, and the input power compensation unit are formed of a one-board module (ASIC) or an Integrated Circuit (IC).

The instantaneous current control unit may allow a ground of a second highest instantaneous current control unit to be connected to a shunt resistor of a second lowest instantaneous current control unit, thereby providing sequential sectional control.

The input power compensation unit may actively control increases in input current and power attributable to variations in input voltage.

The full-wave rectification unit, the instantaneous current control unit, and the input power compensation unit may be packaged in a single chip.

A non-inverting amplifier may be used to achieve high-efficiency design of the instantaneous current control unit.

BRIEF DESCRIPTION OF THE DRAWINGS

The above and other objects, features and advantages of the present invention will be more clearly understood from the following detailed description taken in conjunction with the accompanying drawings, in which:

FIG. 9 is a circuit diagram illustrating an example of a current amplifier (an example of the use of a non-inverting amplifier) which is applied to an instantaneous current control unit; and FIGS. 10*a* to 10*c* are views of diagrams illustrating a prospective product of the high-efficiency AC-driven LED module (ASIC) according to the present invention, to which a control IC has been applied.

DESCRIPTION OF THE PREFERRED EMBODIMENTS

Figure 1:
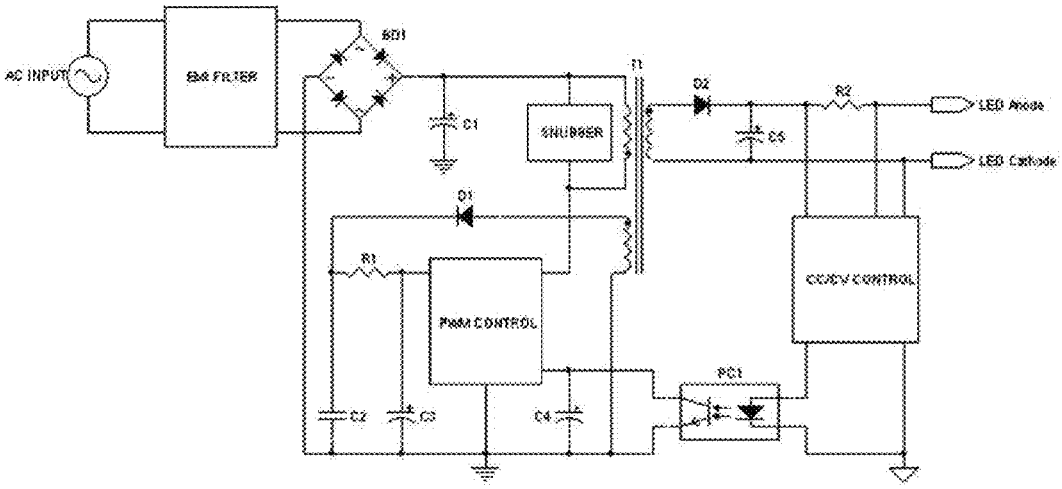
FIG. 1 Prior Art
FIG. 1 is a circuit diagram illustrating a conventional SMPS-type LED driver (using electrolytic capacitors)
Figure 2:
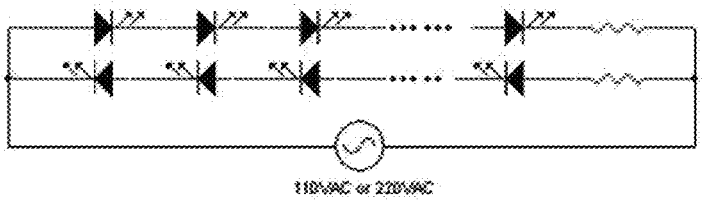
FIG. 2 Prior Art
FIG. 2 is a diagram illustrating the configuration and driving circuit of conventional AC LEDs.
Figure 3:
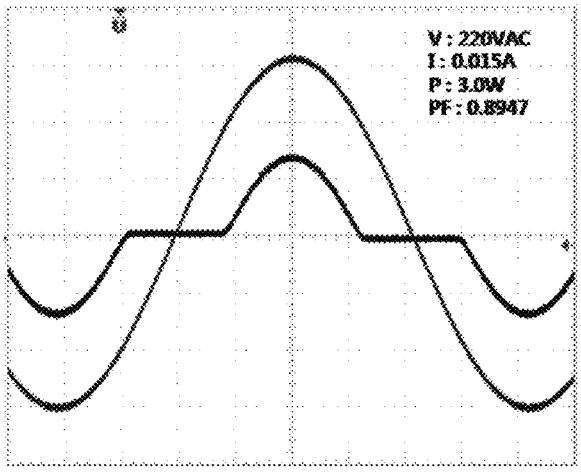
FIG. 3 Prior Art
FIG. 3 is a waveform diagram showing differences in phase between voltage and current at an input terminal while the conventional AC LEDs are being driven.

Reference now should be made to the drawings, throughout which the same reference numerals are used to designate the same or similar components.

Preferred embodiments of the present invention will be described in detail below with reference to the accompanying drawings.

Figure 4A:
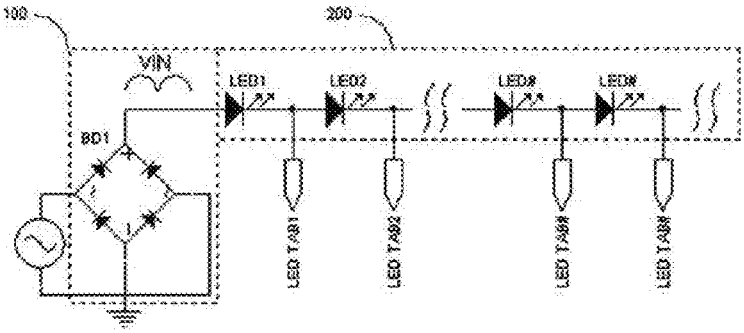
FIGS. 4*a* to 4*c* are views of representative circuit diagram of a high-efficiency AC-driven LED module according to the present invention.
Figure 4B:
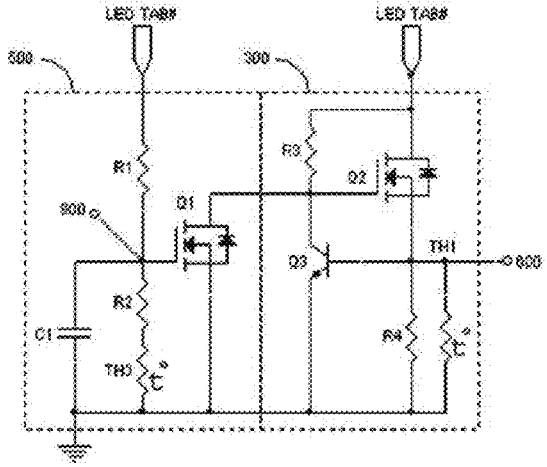
Figure 4C:
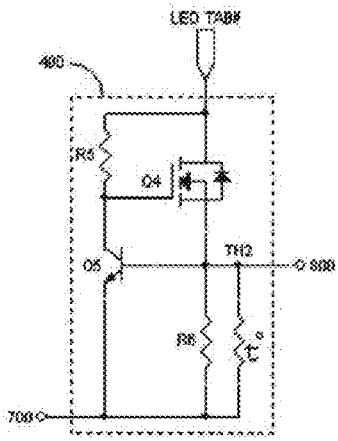
Figure 5:
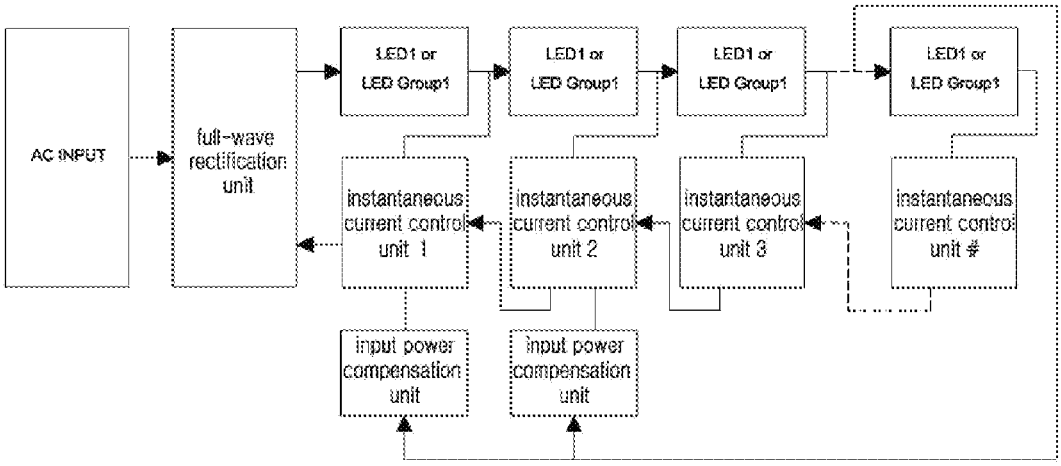
FIG. 5 is a block diagram illustrating an example of the control of the high-efficiency AC-driven LED module according to the present invention.

FIGS. 4*a* to 4*c* are block circuit diagrams schematically illustrating the configuration of a high-efficiency AC-driven LED module according to the present invention, and FIG. 5 is a block diagram illustrating an example of the control of the high-efficiency AC-driven LED module according to the present invention.

As shown in FIGS. 4 and 5, a full-wave rectification unit 100 performs full-wave rectification on commercial supply voltage and supplies it to a series LED unit 200.

The series LED unit 200 is configured such that LEDs are arranged separately or in groups depending on the optimization of the efficiency and power factor. When LEDs are arranged in groups, one instantaneous current control unit 300 is applied to each group.

When voltage via the full-wave rectification unit reaches the threshold voltage of LEDs arranged separately or in groups, current starts to flow to the instantaneous current control unit 300 via LED TAB #.

When the full-wave rectification voltage increases and reaches the threshold voltage of the second highest LED, current starts to flow into a second highest instantaneous current control unit 400 via LED TAB #.

Furthermore, the current of a second lowest instantaneous current control unit 300 decreases by an amount corresponding to an increase in the current of the second highest instantaneous current control unit 400, and, when current of a value equal to or higher than a set value flows, automatic cutoff occurs.

The above operations are sequentially repeated until the maximum value of the full-wave rectification voltage is reached.

When the full-wave rectification voltage that has reached the maximum value drops and reaches a value equal to or lower than the threshold voltage of the highest of the LEDS arranged separately or in groups, current does not flow through the connected LED TAB #.

The above operations are sequentially repeated until the minimum value (0 V) of the full-wave rectification voltage is reached.

That is, the instantaneous current control units 300 and 400 are sequentially controlled depending on the full-wave rectification voltage, as will be described below.

For example, it is assumed that the number of LED groups is four, as shown FIG. 5. The instantaneous current control units 300 and 400 sequentially control the sections of the series LED unit, for example, in the sequence of "LED Group1 control unit ON→LED Group2 control unit ON+LED Group1 control unit OFF→LED Group3 control unit ON+LED Group2 control unit OFF→LED Group4 control unit ON+LED Group3 control unit OFF→LED Group3 control unit ON+LED Group4 control unit OFF→LED Group2 control unit ON+LED Group3 control unit OFF→LED Group1 control unit ON+LED Group2 control unit OFF→LED Group1 control unit OFF," thereby improving the efficiency, the power factor and the Total Harmonic Distortion (THD).

Furthermore, the waveform of current varies depending on the grouped arrangement of the instantaneous current control units 300 and 400. When the groups are divided into smaller-size groups, the efficiency, the power factor and the THD can be further improved.

Moreover, to prevent the power Q2 of the second lowest group instantaneous current control unit 300 from being lost, the ground 700 of the second highest instantaneous current control unit 400 is connected upstream of the shunt resistor R4 of the second lowest instantaneous current control unit 300 (at 600).

Furthermore, the current amplification factors hfe of the Q3 and Q5 of the instantaneous current control units 300 and 400 are increased by the heat generated in the LED unit, and therefore the current of Q2 and Q4 is decreased, thereby reducing input current and input power.

To compensate for this, NTC thermistors are connected adjacent to the Q3, Q5 and B-E terminals of the instantaneous current control units 300 and 400.

That is, the resistance of the NTC Thermistor is decreased by an amount corresponding to the heat generated in the LED unit, and accordingly the combined resistance of resistors R4 and R6 of the instantaneous current control units 300 and 400 is decreased, thereby increasing the current of Q2 and Q4.

The overall range of variations in input current and input power can be minimized by increasing the current of Q2 and Q4 using the NTC thermistors by an amount corresponding to a decrease in the current of Q2 and Q4, which occurs because the current amplification factors hfe of Q3 and Q5 are increased by the heat generated in the LED unit.

Meanwhile, an input power compensation unit 500 is used to actively control Q2 of the instantaneous current control unit 300 in response to variations in input voltage. This is applied not to all instantaneous current control units but to some initial instantaneous current control units.

In this case, R1, R2 and C1 of the input power compensation unit 500 are not used in the second highest instantaneous current control unit 400, and only Q1 is used therein. A parallel connection to the second highest instantaneous current control unit from the gate 800 of Q1 of the input power compensation unit 500 is performed.

Furthermore, the range of variations in input power and input current attributable to variations in input voltage is minimized by controlling Q2 of the instantaneous current control unit 300 using Q1 active control.

In this case, the VGS threshold voltage level of Q1 of the input power compensation unit 500 is decreased by the heat generated in the LED unit, and therefore Q1 operates in an interval equal to or higher a preset operation control interval, thereby resulting in a decrease in input current.

To compensate for this, an NTC thermistor is connected in series to R2 connected between G-S of Q1 of the input power compensation unit 500.

That is, the resistance of the NTC thermistor decreases by a value corresponding to the heat generated in the LED unit, and accordingly the electric potential of G-S of Q1 decreases, thereby compensating for the operation of Q1.

In accordance with the results of tests of samples, the above-described high-efficiency AC-driven LED module according to the present invention exhibited a short range of variations in input power and current over the range of variations in voltage, compared to the conventional AC LEDs, which is summarized in the following Table 1:

TABLE 1

| Item | Conditions | Prior art (AC LED) | Present invention (high-efficiency AC driven LED module) |
|---|---|---|---|
| Power consumption | 200 $V_{ac}$/60 Hz | 1.855 W | 2.763 W |
| | 220 $V_{ac}$/60 Hz | 3.015 W | 2.970 W |
| | 240 $V_{ac}$/60 Hz | 4.365 W | 3.140 W |
| Power variation | 220 $V_{ac}$ ± 10% | −38~+45% | −6.9~5.7% |
| Current variation | 220 $V_{ac}$ ± 10% | −29.6~+29.8% | −2.7~+3.7% |

Figure 6:
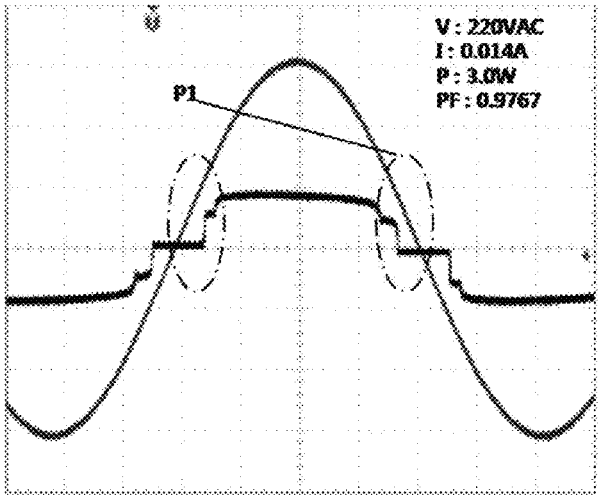
FIG. 6 is a diagram illustrating the waveforms of voltage and current at the input terminal of the high-efficiency AC-driven LED module according to the present invention.

FIG. 6 is a diagram illustrating the waveforms of voltage and current at the input terminal of the high-efficiency AC-driven LED module according to the present invention.

In FIG. 6, P1 denotes the interval where the input current varies due to the application of the input power compensation unit 500.

Figure 7:
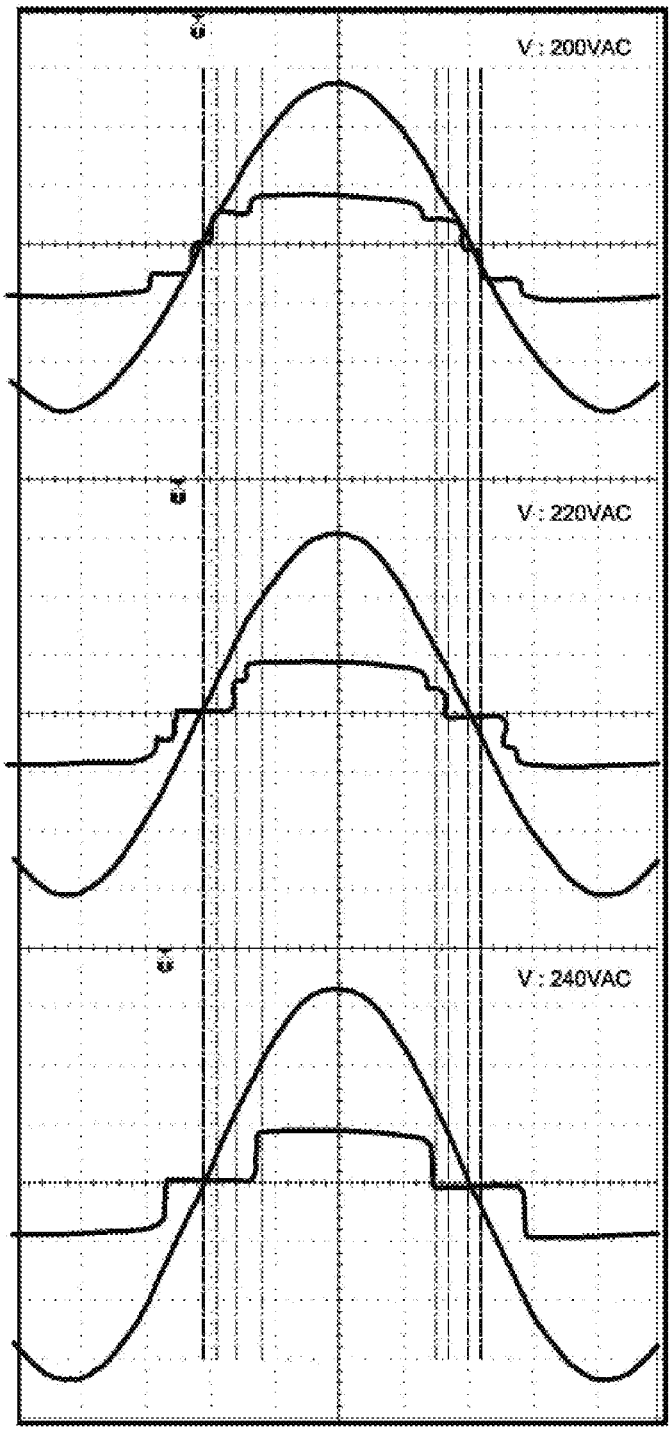
FIG. 7 is a waveform diagram illustrating variations in input current attributable to variations in input voltage in the high-efficiency AC-driven LED module according to the present invention.
Figure 8A:
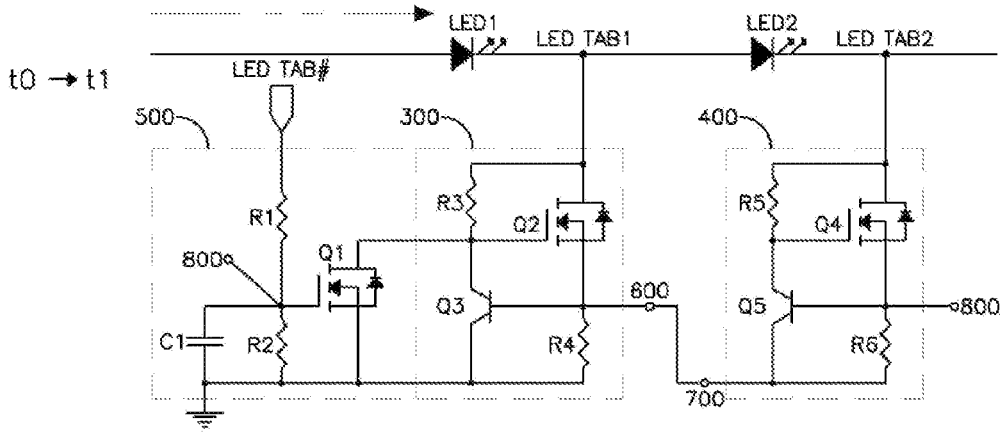
FIG. 8(*a*) to 8(*e*) are views of diagrams showing examples of the operation-based current loops of the LED module of FIG. 4 over time, and FIG. 8(*f*) is a diagram illustrating the waveforms of voltage and current at the input terminal of the LED module of FIGS. 8(*a*) to 8(*e*) over time.
Figure 8B:
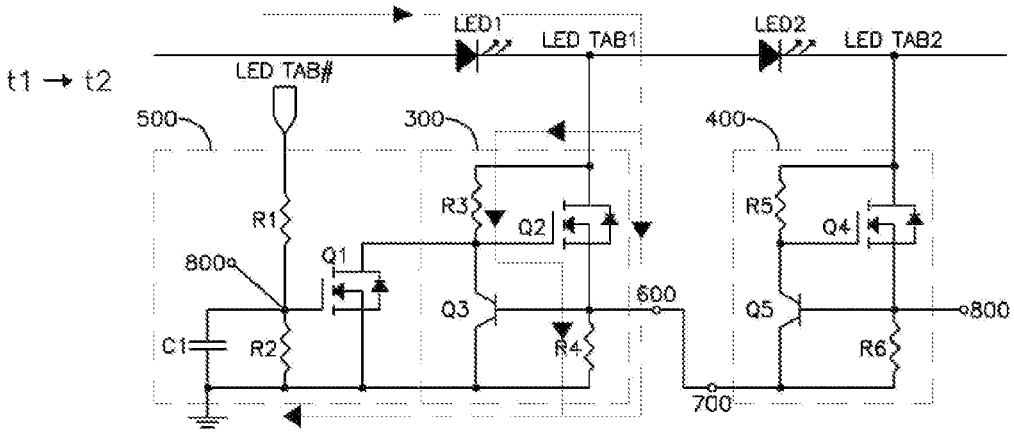
Figure 8C:
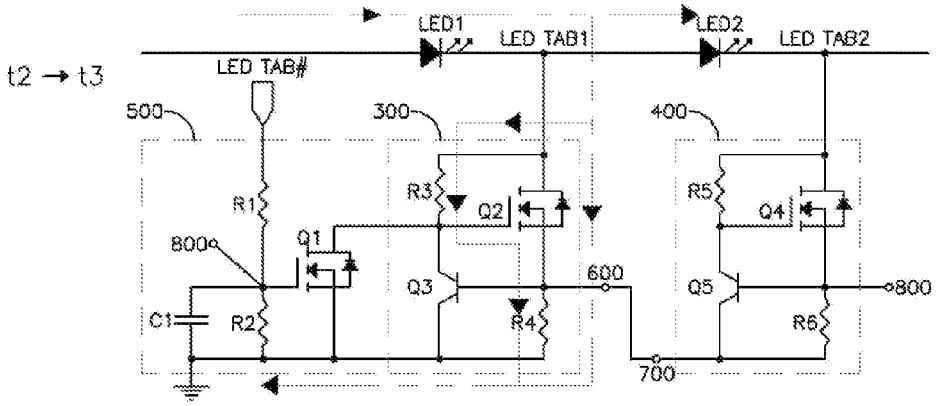
Figure 8D:
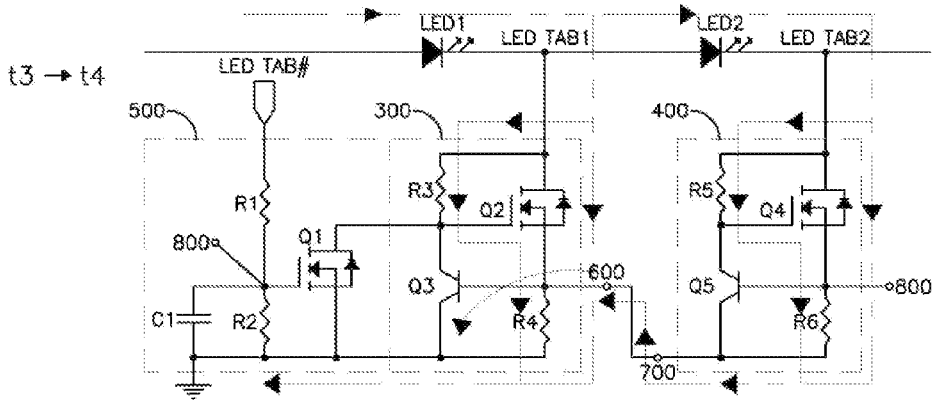
Figure 8E:
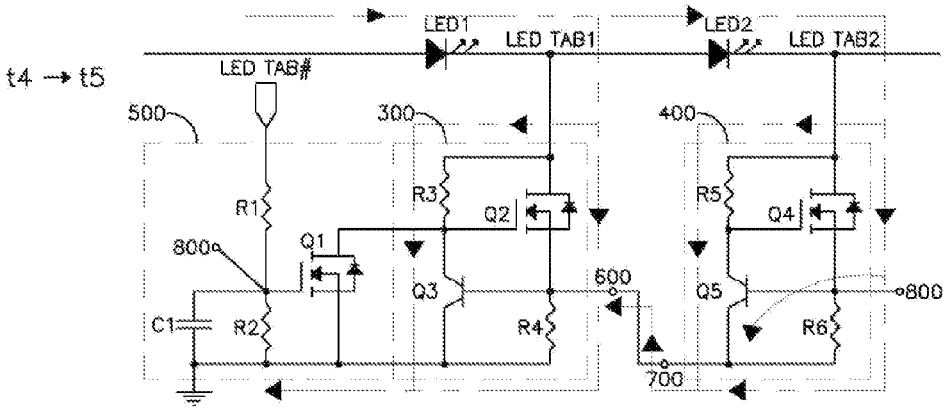
Figure 8F:
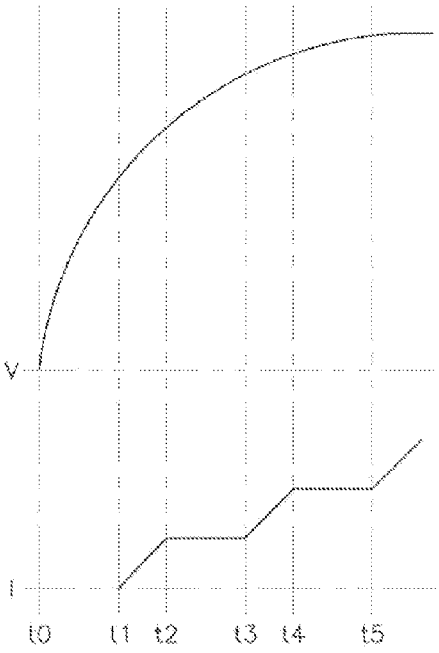

Furthermore, from FIG. 7, it can be seen that as the input voltage increases, the shape of the input current varies.

Meanwhile, referring to FIGS. 8(*a*) to 8(*e*), the operation of the instantaneous current control unit will now be described in detail.

In FIG. 8(*a*), in the interval of t0→t1, the full-wave rectification voltage increases and reaches an LED1 threshold voltage.

In FIG. 8(*b*), in the interval of t1→t2, at LED TAB1, current flows via R3 of the instantaneous current control unit 300, voltage gradually increases accordingly, and, when voltage is applied to Vgs of Q2, the drain current of Q2 is increased to a set value.

In FIG. 8(*c*), in the interval of t2→t3, the set current is kept constant by shunt resistor R4 and Q3 of the instantaneous current control unit 300. In this case, the full-wave rectification voltage increases and reaches the LED2 threshold voltage.

In FIG. 8(*d*), in the interval of t3→t4, at LED TAB2, current flows via R5 of the second highest instantaneous current control unit 400, voltage gradually increases accordingly, and, when voltage is applied to Vgs of Q4, the drain current of Q4 is increased to a set value.

At the same time, as the current of the instantaneous current control unit 400 starts to flow via the shunt resistor R4 600 of the second lowest instantaneous current control unit 300 connected to the ground 700, the current of the second lowest instantaneous current control unit 300 is decreased by an amount corresponding to an increase in the current of the second highest instantaneous current control unit 400, and Q2 is turned off by Q3 at or above a set value.

In FIG. 8(*e*), in the interval of t4→t5, the set current is kept constant by shunt resistors R6 and Q5 of the second highest instantaneous current control unit 400. In this case, the full-wave rectification voltage increases and reaches the LED3 threshold voltage.

The LEDs or LED groups repeat the above operations until the maximum value (Vrms*√2) of the input voltage is reached, and the above operations are repeated in the reverse sequence after the maximum value (Vrms*√2) of the input voltage has been reached.

Furthermore, as a method of maximizing efficiency by reducing loss in a shunt resistor R4, an amplifier, such as that shown in FIG. 9, may be applied when necessary.

FIG. 9 illustrates an example in which a non-inverting amplifier is used, which may be applied to the base terminal of Q3 of the instantaneous current control unit 300.

Moreover, the present invention enables integration and products to be achieved, as illustrated in FIGS. 10*a*-10*c*.

The present invention has the following advantages.

First, high efficiency (about 95%) can be achieved over the overall range of variations in input voltage using a series LED or LED chip interval instantaneous current sequential control method.

Second, a long-life span LED lamp (having a life span equal to that of the LEDs) can be achieved using a control method without requiring an electrolytic capacitor.

Third, the power factor can be considerably improved by sequentially controlling series LEDs and driving them while increasing current, thereby satisfying the regulations (equal to or higher than 0.9) in respective countries.

Fourth, active control is applied to commercial voltage and frequency without modification, and therefore electromagnetic waves are weak, so that a minimum number of filters are required, thereby reducing the manufacturing cost.

Fifth, the brightness of the LED lamp can be kept stable by actively controlling power and current consumed with regard to the variations in input voltage and the LED characteristics.

Sixth, the LED module of the present invention is suitable for triac-dimming control, like an incandescent lamp, so that a wide interval and a dimming start point can be controlled.

Seventh, it is possible to implement the LED module using a one-board module (ASIC) thanks to the small size, the integrated circuit configuration and the low control loss.

Eighth, when the LED modules are used in parallel, there is a guarantee that the capability of the lamp will be sufficiently extended.

Ninth, the assembly structure is simple, and therefore a sufficient heat transfer area can be ensured, so that the heat dissipation design is considerably facilitated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high-efficiency Alternating Current (AC)-driven Light-Emitting Diode (LED) module, comprising:

a full-wave rectification unit configured to rectify commercial supply voltage;

an LED unit configured such that LEDS connected in series are arranged separately or in groups;

at least one instantaneous current control unit configured to sequentially control sections of the LEDs connected in series; and at least one input power compensation unit configured to actively control variations in input current and power attributable to variations in input voltage;

wherein the full-wave rectification unit, the LED unit, the instantaneous current control unit, and the input power compensation unit are formed of a one-board module (ASIC) or an Integrated Circuit (IC);

wherein the instantaneous current control unit allows a ground of a second highest instantaneous current control unit to be connected to a shunt resistor of a second lowest instantaneous current control unit, thereby providing sequential sectional control.

2. The high-efficiency AC-driven LED module as set forth in claim 1, wherein the input power compensation unit actively controls increases in input current and power attributable to variations in input voltage.

3. The high-efficiency AC-driven LED module as set forth in claim 1, wherein the full-wave rectification unit, the instantaneous current control unit, and the input power compensation unit are packaged in a single chip.

4. The high-efficiency AC-driven LED module as set forth in claim 1, wherein a non-inverting amplifier is used to achieve high-efficiency design of the instantaneous current control unit.

* * * * *